United States Patent [19]

O'Brien et al.

[11] 3,982,746

[45] Sept. 28, 1976

[54] DIRECT MAIL ADVERTISING BOOKLET AND METHOD OF PRODUCTION

[75] Inventors: William J. O'Brien, Plandome Heights, N.Y.; John Sakal, Dayton, Ohio

[73] Assignee: The Standard Register Company, Dayton, Ohio

[22] Filed: June 23, 1975

[21] Appl. No.: 589,713

Related U.S. Application Data

[62] Division of Ser. No. 330,214, Feb. 7, 1973, Pat. No. 3,899,381.

[52] U.S. Cl. ..... 270/37; 270/41

[51] Int. Cl.[2] ..... B41L 43/12

[58] Field of Search ..... 270/4, 5, 10, 32, 37, 270/41, 43, 52; 93/36 MM, 36 M, 36.01, 35 R, 61 A, 63 R, 63 M, 73; 229/68 R, 71, 73, 69; 156/204, 227, 277, 252, 269, 384, 459

[56] References Cited

UNITED STATES PATENTS

| | | | |
|---|---|---|---|
| 2,969,003 | 1/1961 | Rapp | 93/63 M |
| 3,104,799 | 9/1963 | Steidinger | 229/69 |
| 3,411,699 | 11/1968 | Pine | 229/73 |
| 3,554,438 | 1/1971 | Malderghem | 229/69 |
| 3,665,817 | 5/1972 | Katz | 270/37 |
| 3,743,273 | 7/1973 | Katz | 270/37 |

*Primary Examiner*—Edgar S. Burr
*Assistant Examiner*—A. Heinz
*Attorney, Agent, or Firm*—Jacox & Meckstroth

[57] ABSTRACT

A low cost self-contained, direct-mail advertising booklet, particularly adapted to be a self-mailer type of booklet. A plurality of continuous strips or sheets of paper-like material are superposed and attached together to form a series of booklets in a continuous web. Personalized information such as a name, address, etc. is applied to a portion of the web or to a card or sheet or the like which is attached to the web. The web is folded so that the personalized information is used as a mailing address for the booklet. Separation of the booklet from the web may occur before or after folding occurs. The portion of each booklet which carries the personalized information may be readily removed from other portions of the booklet and placed in the mail by the receiver of the booklet to indicate his acceptance of an offer or the like set forth in the booklet.

2 Claims, 11 Drawing Figures

XY Co
Memo

RT Co.
BOX 12
CARTON
USA
Mr. K.C. Jones
22 Penn St.
Loco Mo.

DIRECT MAIL ADVERTISING BOOKLET AND METHOD OF PRODUCTION

RELATED APPLICATION

This application is a division of U.S. patent application Ser. No. 330,214, filed Feb. 7, 1973 now U.S. Pat. No. 3,899,381.

BACKGROUND OF THE INVENTION

In the past, direct-mail advertising booklets have been produced in quantities by various methods, and each booklet has been mailed in a special envelope to a prospective customer with a personalized cover letter. Of course, such production of the booklets, with cover letters, has been relatively expensive. For example, several pieces have been produced and then brought together for mailing in an envelope or the like.

SUMMARY OF THE INVENTION

The invention comprises the production of booklets, such as direct mail advertising booklets, particularly the self-mailer type of direct mail advertising booklets. The booklets are produced by forming a continuous web which includes a plurality of superposed paper-like continuous strips or sheets. The sheets or strips are scored or partially severed at spaced-apart intervals to provide sections. The strips are adhesively attached together. Scoring of the strips to provide sections may occur before or after the strips are collated and attached together. A portion of each section of one of the strips is provided with personalized information, such as a name, address, etc. The web is then burst into booklet portions and then folded. Alternatively, portions of the web are folded, and then the web is burst into booklet portions. The booklet is then ready for mailing. The personalized portion of each booklet can be readily removed by the recipient and mailed back to the sender of the booklet to indicate acceptance of an offer or the like set forth in the booklet.

Thus, an object of this invention is to provide a personalized self-mailer type of direct mail advertising booklet which can be produced at relatively low costs.

Another object of the invention is to provide a method or methods of producing such a booklet.

Other objects and advantages of the invention reside in the construction of parts, the combination thereof, the method of manufacture, and the manner of use, as will become more apparent from the following description.

DETAILED DESCRIPTION OF THE INVENTON

Figures 1, 2, 3, 4, 5, 6:
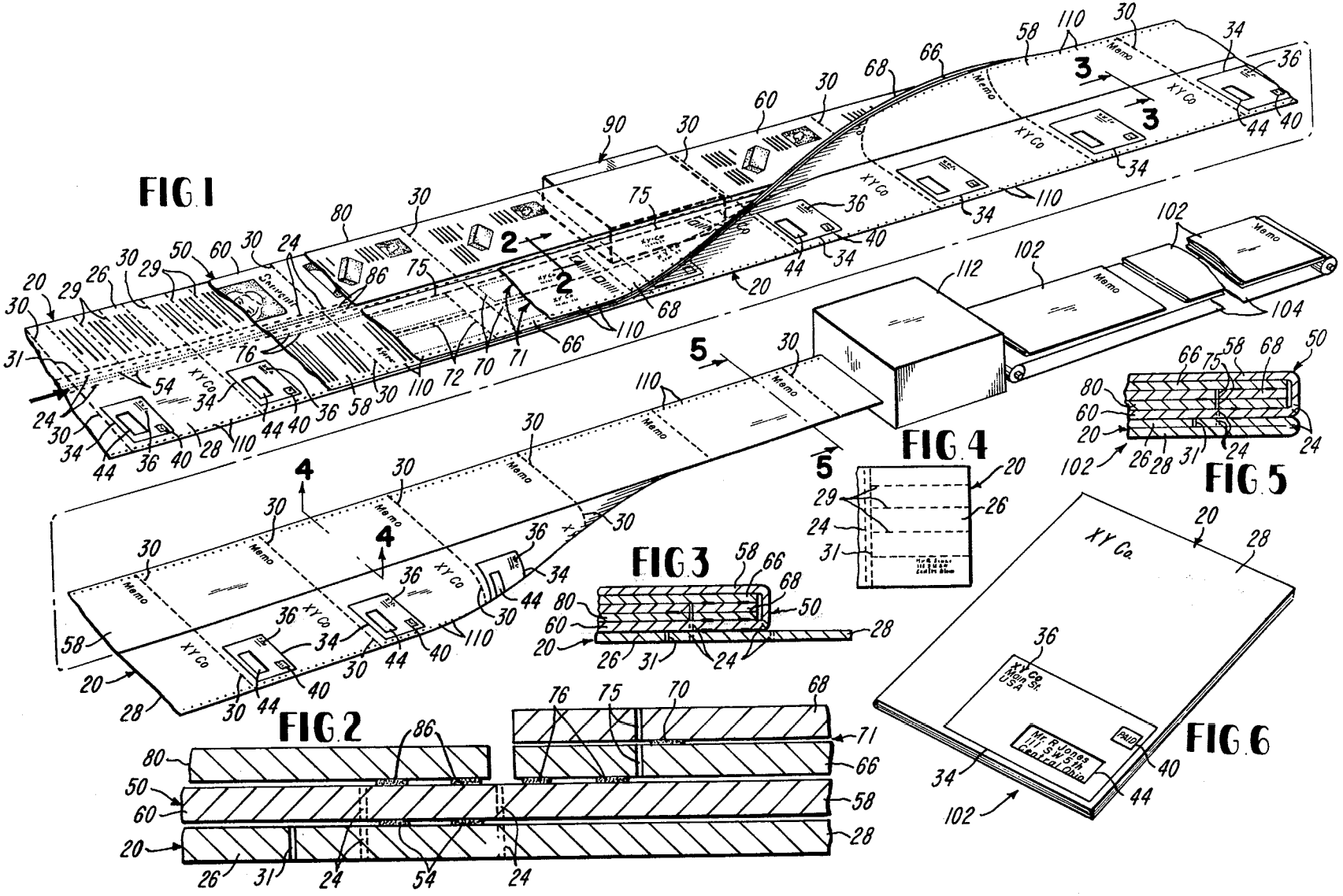
FIG. 1 is a schematic type of perspective view illustrating a method and apparatus for producing direct mail advertising booklets in accordance with this invention.
FIG. 2 is an enlarged sectional view taken substantially on line 2—2 of FIG. 1.
FIG. 3 is an enlarged sectional view taken substantially on line 3—3 of FIG. 1 and drawn on a smaller scale than FIG. 2.
FIG. 4 is a view taken substantially on line 4—4 of FIG. 1.
FIG. 5 is an enlarged sectional view taken substantially on line 5—5 of FIG. 1 and shown on a smaller scale than FIG. 2.
FIG. 6 is a perspective view showing a direct mail advertising booklet made in accordance with this invention.

FIG. 1 illustrates a method of production of booklets according to this invention. A continuous strip or sheet 20 of paper-like material has a plurality of closely spaced longitudinally extending score lines 24 at the central portion thereof. The score lines 24 divide the strip 20 into a longitudinally extending portion 26 and a longitudinally extending portion 28. The continuous strip 20 has transverse perforation lines 30 at spaced-apart positions, which divide the continuous strip 20 into sections. As shown in the upper left hand part of FIG. 1, the portion 26 in each section has printing thereupon which is separated by transverse perforation lines 29 and longitudinal perforation lines 31. The portion 28 of each section has a printed rectangle 34, a return address 36 and a postage permit statement 40 printed thereupon. Within the rectangle 34 is a window or opening 44.

Positioned upon the continuous strip 20 is a continuous strip 50 which has substantially the same width as the continuous strip 20. The strip 50 has score lines 24 which are directly above the score lines 24 of the strip 20. The strip 50 is attached to the strip 20 by adhesive spots or lines 54. The strip 50 is divided into portions 58 and 60 by the score lines 24 and each portion thereof contains printed advertising material or the like on one or both of the surfaces thereof. Transverse perforation lines 30 in the strip 50 are directly above the transverse perforation lines 30 in the strip 20.

As shown in FIGS. 1 and 2, positioned upon the portion 58 of the strip 50 and having a width substantially equal to one-half the width of the strips 20 and 50 are superposed continuous strips 66 and 68 which are attached together by transverse longitudinal lines or spots 70 of adhesive material to form envelopes 71 which are partially separated from the strips 66 and 68 by transverse and longitudinally extending perforation lines 72. The strip 66 is attached to the portion 58 of the strip 50 by lines or spots 76 of adhesive material. The strips 66 and 68 have longitudinal score lines 75. The upper surface of the envelopes 71 has address information and postage indicia printed thereupon. The address information is usually that of the mailer of the booklets.

Positioned upon the portion 60 of the strip 50 and having a width substantially equal to one-half the width of the strip 50 is a continuous strip 80 which has advertising material printed upon one or both surfaces thereof. The strip 80 and the strips 66 and 68 have spaced-apart transverse perforation lines 30 which are directly above the perforation lines 30 of the strips 20 and 50. The strip 80 is attached to the portion 60 of the strip 50 by lines or spots 86 of adhesive material, as shown in FIG. 2. The perforation lines 30 may be applied to the strips 20, 50, 66, 68 and 80 after they are attached together, if desired, rather then prior to collating and attachment, in the manner discussed above.

After such positioning and attaching together of the strips 20, 50, 80, 66 and 68, the strips are moved over high speed printer apparaatus 90 or the like, which is ordinarily computer operated, and personalized information, such as the name and address of a recipient, is applied to the lower surface of the portion 26 of the strip 20. Feed holes 110 are shown in the strips 20, 50, 80, 66 and 68 for movement thereof.

Then, as illustrated in the upper right hand part of FIG. 1, the portion 58 of the strip 50 and the strips 66 and 68 are then folded over the strips 80, 50 and 20, so that the strip 68 comes into engagement with the strip 80, and the portion 58 of the strip 50 is then uppermost above the strip 80, as shown in FIG 3. Then as illustrated in the lower part of FIGS. 1 and 5, the portion 28 of the strip 20 is folded under the portion 26 of the strip 20.

Thus a web as illustrated in FIG. 5 is formed. The web is moved through burster apparatus 112, or the like, and the web is severed at the perforations lines 30 to form booklets 102, as shown in FIG. 1, supported upon a conveyor belt 104, or the like. When the booklets 102 are removed from the conveyor belt 104 and turned over, they appear as shown in FIG. 6, with the personalized name and address printed upon the portion 26 of the strip 20, appearing through the window 44 of the portion 28 of the strip 20. The booklet 102 is then ready for mailing to the name and address which appears in the window 44.

After the person receives the booklet 102, he may sever a personalized part of the portion 26 (a part which carries his name and address) from the strip 20. Such severance occurs along perforation lines 29 and 31. The severed part may then be placed into an envelope portion 71 which can be severed from the strips 66 and 68. Such severance of an envelope portion 71 occurs along perforation lines 72 and 75. The envelope 71 which has the personalized portion 26 of the strip 20 therein is then placed in the mail for transmittal of the addressee named on the envelope 71.

Instead of severing a personalized portion from the strip 20, a card or sheet portion or the like may be removably attached to and carried by a surface of the strip 20 and removed therefrom and mailed without enclosure or placed in an envelope, such as the envelope 71 for mailing.

FIGS. 7–11

Figures 7, 8, 9, 10, 11:
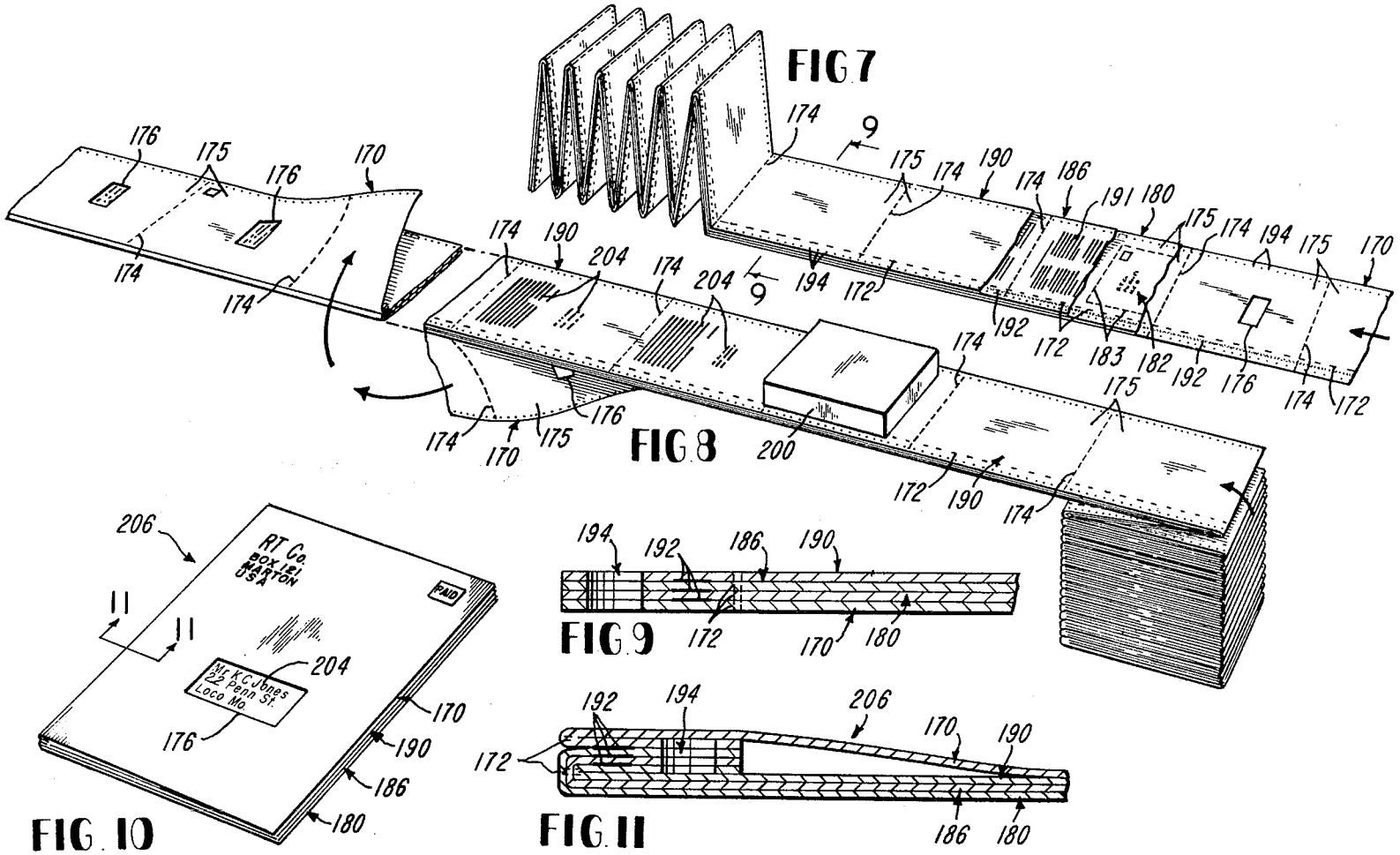
FIGS. 7 and 8 are perspective views illustrating another modification of the method of producing booklets according to this invention.
FIG. 9 is an enlarged sectional view taken substantially on line 9—9 of FIG. 7.
FIG. 10 is a perspective view of a booklet produced in the manner illustrated in FIGS. 7 and 8.
FIG. 11 is an enlarged sectional view taken substantially on line 11—11 of FIG. 10.

FIGS. 7–11 illustrate production of another booklet of this invention. A continuous strip 170 shown in FIG. 7, is provided with a longitudinal score line 172 adjacent an edge thereof, and transverse spaced-apart perforation lines 174. The perforation lines 174 divide the strip into sections 175, each of which has a window 176. Positioned upon the continuous strip 170 is a continuous strip 180 which is divided into sections 175 by transverse perforation lines 174 directly above the perforation lines 174 of the strip 170. Each section 175 of the strip 180 has a card portion 182 outlined by perforations 183, and each section 175 may also include advertising material or the like.

Positioned upon the continuous strip 180 is a continuous strip 186 which carries advertising material 191 or the like. Positioned upon the strip 186 is a continuous strip 190 which may also carry advertising material 191 or the like. Each of the strips 180, 186, and 190 is substantially equal in width to the strip 170 and is provided with a score line 172 immediately above the score line 172 of the strip 170. Each of the strips 180, 186 and 190 has transverse perforation lines 174, immediately above the transverse perforation lines 174 of the strip 170 and which separate the strip 180, 186 and 190 into sections 175. The strips 170, 180, 186 and 190 are attached together adjacent the score lines 172 by adhesive lines 192 or the like. The strips 170, 180, 186 and 190 may have the perforation lines 174 applied thereto following collating and attachment together thereof, if desired, rather than prior to the collating and attaching thereof. Marginal holes 194 are used to move the strips 170, 180, 186 and 190 and the web formed thereby.

After the strips 170, 180, 186 and 190 are so formed into a web, the web is folded in the manner shown at the left hand part of FIG. 7 for formation of a pack, for transportation to a customer.

As illustrated in FIG. 8, the customer then moves the web from the pack thereof to printer apparatus 200 or the like, which applies personalized information 204, such as a name and an address, or the like, to each section 175 of the strip 190.

The strip 170 is then foldedly moved from the under side of the web to the upper side thereof, as illustrated in FIG. 8. The web is then burst by any suitable means to form booklets, such as a booklet 206 shown in FIG. 10.

FIG. 11 shows that as the strip 170 is foldedly moved from under the strip 180 to a position above the strip 190, as illustrated in FIG. 8, the strips 170, 190, 186, and 180 are folded at the score lines 172, and the marginal portions of the strips 170, 190, 186, and 180 are folded between the strips 170 and 190.

Thus, it is understood that several types of booklets may be produced in accordance with this invention.

It is to be understood that in accordance with this invention personalized information may be applied to sheets or cards which are attached to a strip in spaced-apart relationship along the length of the sheet. For example, one of the continuous strips in a continuous web may have spaced-apart card members or sheets attached thereto by adhesive means or by staples or the like along the length of the strip and personalized information is applied thereto in a manner such as that discussed above.

Although the preferred embodient of the invention has been described, it will be understood that within the purview of this invention various changes may be made in the form, details, proportion and arrangement of parts, the combination thereof, and manner of use which generally stated consist in booklet structure and method of production thereof as defined in the appended claims.

The invention having thus been described, the following is claimed:

1. The high speed method of producing personalized booklets for bulk mailing comprising:

superposing a plurality of individual continuous strips of paper-like material, there being a lowermost continuous strip and an uppermost continuous strip, each of the continuous strips having opposed longitudinal edges, the lowermost continuous strip having spaced-apart openings therein, at least one of the continuous strips having repetitive printed material thereupon, attaching the continuous strips together along one longitudinal edge thereof to form a multiple ply web, printing personalized name and address information upon the uppermost continuous strip at spaced-apart portions along the length thereof, the personalized name and address information printed upon one portion being different from the name and address information printed upon any of the other spaced-apart portions, longitudinally folding substantially the entire lowermost continuous strip over the uppermost continuous strip along said longitudinally attached edge to expose the personalized name and address information through the openings in the lowermost continuous strip, severing the multiple ply web along spaced-apart transverse lines.

2. The high speed method of producing personalized booklets for bulk mailing comprising:

superposing a plurality of individual continuous strips of paper-like material, at least one of the strips having spaced-apart portions provided with repetitive printed material, there being a second continuous strip above a first continuous strip, each of the continuous strips having a marginal edge portion, the marginal edge portions being superposed, the first continuous strip having longitudinally extending portions provided with openings therethrough, attaching the continuous strips together in superposed relation along said superposed longitudinal marginal edge portions thereof, each of the continuous strips being provided with a longitudinally extending score line adjacent the marginal edge portion thereof, printing personalized name and address information at spaced-apart locations on the upper surface of the second continuous strip, the personalized name and address information at each location being different from the name and address information at each other location, longitudinally folding substantially the entire first continuous strip and the marginal edge portions of the strips over the second continuous strip so that the personalized name and address information appears through the openings in the first continuous strip, each of the strips being folded at the longitudinally extending score line thereof, severing the strips along spaced-apart transverse lines.

* * * * *